US008505434B2

(12) United States Patent
Wieland

(10) Patent No.: US 8,505,434 B2
(45) Date of Patent: Aug. 13, 2013

(54) FIRE GUIDANCE DEVICE FOR A HAND FIRE WEAPON

(75) Inventor: Gerhard Wieland, Rielasingen-Worblingen (DE)

(73) Assignee: Rheinmetall Soldier Electronics GmbH, Stockach (DE)

( * ) Notice: Subject to any disclaimer, the term of this patent is extended or adjusted under 35 U.S.C. 154(b) by 386 days.

(21) Appl. No.: 12/838,312

(22) Filed: Jul. 16, 2010

(65) Prior Publication Data

US 2011/0010981 A1 Jan. 20, 2011

(30) Foreign Application Priority Data

Jul. 16, 2009 (DE) ..... 10 2009 033 567

(51) Int. Cl.
*F41G 3/08* (2006.01)

(52) U.S. Cl.
USPC ..... 89/203; 89/41.03; 42/105

(58) Field of Classification Search
USPC ..... 89/41.03, 41.05, 41.06, 203, 204, 89/205; 42/105
See application file for complete search history.

(56) References Cited

U.S. PATENT DOCUMENTS

| | | | | |
|---|---|---|---|---|
| 5,824,942 | A * | 10/1998 | Mladjan et al. | 89/41.17 |
| 8,047,118 | B1 * | 11/2011 | Teetzel et al. | 89/41.17 |
| 8,100,044 | B1 * | 1/2012 | Teetzel et al. | 89/41.17 |

FOREIGN PATENT DOCUMENTS

| | | | |
|---|---|---|---|
| DE | 32 91 42 | A | 12/1917 |
| DE | 10 2005 007 910 | A1 | 8/2006 |
| DE | 10 2008 015 423 | A1 | 10/2008 |
| WO | 2008/092548 | | 8/2008 |

OTHER PUBLICATIONS

Valhalla Armory Tactical Shooting Supply, website: www.centuriontactical.com/picatinny-rails.htm, featuring Picatinny Rails, pp. 1-2.

* cited by examiner

*Primary Examiner* — Stephen M Johnson
(74) *Attorney, Agent, or Firm* — Griffin & Szipl, P.C.

(57) ABSTRACT

A fire guidance device for a hand fired weapon is suitable for day and night deployment for large caliber and slow flying ammunition or missiles, such as, for example, 40 mm grenade throwers and anti tank weapons. The fire guidance device also serves to determine and automatically adjust a set-up angle for adjustment of ballistics, and a lateral angle for spin correction. The fire guidance device is attached to the weapon so it can be tilted automatically or manually and twisting is thereby dependent upon a required set-up angle of the weapon so that direct view, by the operator, to the target is preserved. For spin correction, a defined angle in horizontal orientation is adjusted between axes of the fire guidance device and the weapon. Alternatively, the fire guidance device is mounted vertically and a required cant (tilt) is then indicated in a display, followed by tilt adjustment.

18 Claims, 7 Drawing Sheets

FIRE GUIDANCE DEVICE FOR A HAND FIRE WEAPON

This application claims priority from German Patent Application No. 10 2009 033 567.6, filed Jul. 16, 2009, the entire disclosure of which is incorporated herein by reference.

FIELD OF THE INVENTION

The invention concerns a fire guidance device for a hand fire weapon that is suitable for day and night use, in particular, for large caliber and slow flying ammunition and/or projectiles for short and medium range of transmission, such as, for example, 40 mm mortars and anti-tank weapons/bunker weapons and similar weapons. The fire guidance device also serves for determination and automatic adjustment of angle of elevation for adaptation of ballistics, and of the lateral angle for spin correction of hand fire weapons with relatively large angle of elevation.

BACKGROUND OF THE INVENTION

A portable, recoil-low weapon system is known from WO 2008/092548 A1, which is provided with a fire guidance that is effective vis-à-vis static and mobile targets and deployable during day and night. This portable multi-purpose weapon distinguishes itself in that the integrated fire guidance permits assignment of target. It presents, in addition to the integrated fire guidance, a distance measuring device as well as an optical system parallel to the tubular axis. Sensors around relevant axes at the weapon structure ascertain elevation-angles and azimuthal angles of the weapon. The fire guidance comprises a processor, in which calculation is done of lead-distance and ejection distance of the missile to be fired. These data are then programmed onto the missile.

With weapons of larger calibers of relatively low firing velocities, such as, for example, 40 mm mortars, anti-tank weapons, anti-bunker weapons and the like, the curvature of the flight path is more pronounced and must, therefore, also be taken into consideration when aiming. Aiming can no longer be done parallel to the tubular axis of the bore, but aiming must be considerably higher. In doing so, there is the problem that, as a rule, the reticule in the field of vision must be mechanically or electronically displaced. Displacement, however, is only possible up to the edge of the field of vision. In the marginal area of the optics there are, in addition, distortions. Alternatively, one can have larger design optics, which is a disadvantage when it comes to construction size and weight, or one chooses extremely high-grade optics, which is very expensive.

A sighting device with target view for weapons, in particular with respect to ammunition for extended or super-elevated flight paths, is known from DE 10 2008 015 423 A1, where the aim remains for the viewer in the center of the field of vision even in case of tubular elevation. The sighting device has at least two optical systems, wherein the first optical system is integrated on the side of the objective and the other optical system(s) are on the ocular side. The optical systems can be tilted and/or twisted, wherein the ocular-side optical system is firmly attached to the barrel of the weapon.

Missiles that are shot from weapons with a cocked barrel, are, in turn, provided with rifling while passing through the barrel of the weapon. The rifling, however, produces an unwelcome lateral deviation of the flight path. In order to correct the lateral deviation, the notch for the C-96 Mauser pistol, for example, is placed in a skewed fashion.

At this point, the invention picks up on the object of providing a fire guidance device for hand firing weapons, which is designed for a weapon with a relatively large set-up angle.

SUMMARY OF THE INVENTION

The object of the invention is solved by the characteristics of a first embodiment of the invention directed to a hand firing weapon (100) for shooting ammunition or missiles with extended or super-elevated flight paths having a fire guidance device (1) whereby the fire guidance device (1) is fastened at or on the weapon (100) in such manner that it can automatically or manually be swiveled or twisted relative to the axis of the weapon, and swiveling is thereby dependent upon a required set-up angle of the weapon (100) so that direct line-of-sight view towards the target by the operator remains preserved. Additional beneficial embodiments of the invention are described below as follows.

In accordance with a second embodiment of the present invention, the first embodiment is modified so that swiveling of the fire guidance device up to 90° about a pivot axis is provided. In accordance with a third embodiment of the present invention, the first embodiment or the second embodiment are further modified so that in the fire guidance device or at the weapon (100) are integrated a distance meter (15) for measuring the distance of the target, an inclination meter for measuring target line inclination, an inclination meter for measuring tilting and an angle coder for measuring the adjusted set-up angle. In accordance with a fourth embodiment of the present invention, the first embodiment, the second embodiment and the third embodiment are further modified so that an air pressure sensor for measuring ambient air pressure, and a temperature sensor for measuring the environmental temperature, are integrated in the fire guidance device (1) of the weapon (100). In accordance with a fifth embodiment of the present invention, the first embodiment, the second embodiment, the third embodiment, and the fourth embodiment are further modified so that the fire guidance device comprises at least one red light laser marker (12) as well as an infra-red laser marker (13) and an infra-red laser target illuminator, as well as a display (3).

In accordance with a sixth embodiment of the present invention, the first embodiment, the second embodiment, the third embodiment, the fourth embodiment, and the fifth embodiment, are further modified so that a computer, or the like, is integrated for processing or manipulation of measuring values of sensors, and for adjustment of set-up angle of the fire guidance device (1) at the weapon (100), whereby the computer is preferably installed in the fire guidance device (1). In accordance with a seventh embodiment of the invention, the sixth embodiment is further modified so that data are deposited in the memory of the computer, such as diverse ballistics curves and spin correction curves and spin correction angles etc., for determination of the set-up angle.

In accordance with an eighth embodiment of the present invention, the first embodiment, the second embodiment, the third embodiment, the fourth embodiment, the fifth embodiment, the sixth embodiment, and the seventh embodiment, are further modified so that operating elements (4, 5, 6, 7) are affixed at the fire guidance device (1) so that the possibility exists for manual input of the most important ballistics parameters in order to have a "fall-back" position in case of failure of individual sensors or other problems. In accordance with a ninth embodiment of the present invention, the first embodiment, the second embodiment, the third embodiment, the fourth embodiment, the fifth embodiment, the sixth embodiment, the seventh embodiment, and the eighth embodiment are further modified so that a connection (8) at the fire guidance device (1) serves for joining the fire guidance device (1) with a trigger switch at the weapon (100) via a connectable trigger cable. In accordance with a tenth embodiment of the present invention, the first embodiment, the second embodiment, the third embodiment, the fourth embodiment, the fifth embodiment, the sixth embodiment, the seventh embodiment, the eighth embodiment, and the ninth embodiment are further modified so that a turning button (9) and a scale (10) are provided for emergency operation. In accordance with an eleventh embodiment of the present invention, the first embodiment, the second embodiment, the third embodiment, the fourth embodiment, the fifth embodiment, the sixth embodiment, the seventh embodiment, the eighth embodiment, the ninth embodiment, and the tenth embodiment are further modified so that an exchangeable optical target assistance means (12) is mountable at the fire guidance device (1) by means of a Picatinny rail.

In accordance with a twelfth embodiment of the present invention, the first embodiment, the second embodiment, the third embodiment, the fourth embodiment, the fifth embodiment, the sixth embodiment, the seventh embodiment, the eighth embodiment, the ninth embodiment, the tenth embodiment and the eleventh embodiment are further modified so that a defined angle in horizontal orientation is adjusted between the axes of the fire guidance device (1) and the weapon (100), which serves for correction of spin. In accordance with a thirteenth embodiment of the present invention, the twelfth embodiment is further modified so that tilting occurs of the fire guidance device (1) relative to the vertical axis of the weapon during adjustment of the set-up angle. In accordance with a fourteenth embodiment of the present invention, the twelfth embodiment is further modified so that the fire guidance device (1) is mounted vertically and indicates a required tilting at the display (3), which must then be entered. In accordance with a fifteenth embodiment of the present invention, the fourteenth embodiment is further modified so that the tilting can be represented in the display (3) in the form of an artificial horizon as a sloping line or a symbol to be aligned vertically.

In accordance with a sixteenth embodiment of the present invention, the fourteenth embodiment and the fifteenth embodiments are further modified so that the representation is dynamic, whereby the tilt angle is measured cyclically and depending upon size and orientation of the tilt, the display is represented accordingly. In accordance with a seventeenth embodiment of the present invention, the fourteenth embodiment, the fifteenth embodiment and the sixteenth embodiment are further modified so that the display of the correctly adjusted tilt angle can be effected by means of an LED or a vibration element at the scanner of the trigger cable.

The underlying concept of the invention is to integrate the fire guidance device in such a manner with the weapon that, while aiming the weapon, direct view of a target by the operator (direct alignment) is preserved. In a further refinement of the invention, spin correction is sought with the assistance of the fire guidance device.

The fire guidance device preferably comprises all sensors and/or target devices—at least partially—for the intended function. The fire guidance device is preferably automatically, by up to 90°—but also manually—, tiltable relative to the weapon's pivot axis (See FIG. 6), in other words, around the vertical axis of the weapon and/or it can be twisted in the lateral angle range (See FIG. 6). The automatic tilting, as well as manual tilting, depends upon the required set-up angle of the weapon. The set-up angle (i.e., vertical angle) between tubular axis of the bore of the weapon and visual axis reportedly—as is generally known—depends upon the weapon, the ammunition, the distance of the target, environmental conditions such as air pressure and air temperature, missile velocity, target line angle and other parameters. If one wants to take these parameters into consideration, the most important parameters should be measured by means of sensors, recorded, and taken into account in the ballistics calculation and adjustment. The required sensors are preferably integrated in the fire guidance device, but can also be partially integrated in the weapon. Therefore, preferably provided in the fire guidance device are (i) distance meters for measuring the distance of the target, (ii) an inclination meter for target line inclination, and (iii) an inclination meter for tilting as well as an angle coder for the adjusted set-up angle. In addition, (iv) an air pressure sensor and (v) a temperature sensor can be considered for the environmental temperature in order to determine the relevant ballistic values. Direct line-of-sight aiming can be done, for example, with the integrated red light laser-marker or with the infra-red laser-marker, as well as in combination of all, even with a large set-up angle. During the day, aim can also be taken with the adapted target device (e.g., red point sighting device, holographic sighting device, etc.).

By tilting the entire fire guidance device the advantage produced is that the target assisting means and sensors, which are installed in the fire guidance device, are all, in each (angle) position of the fire guidance device, correctly aligned, parallel to each other, or remain so. The IR-illuminator can thus be used in combination with the laser target marker, or also with an optical target device. Likewise, the installed laser distance meter can be used in each position. Returning to "zero position," or similar maneuvering with renewed aim-taking, is not required. Also, when changing over from one target to another, interim steering to "zero position" is no longer needed.

By way of refinement, the fire guidance device has the possibility of manual input of the most important ballistic parameters so as to have a fall-back position in the event of a breakdown of any sensors used to provide information to calculate the set-up angle, or other problems. Furthermore, the possibility exists to enter off-set values in the set-up angle and the target distance. This feature permits entry of off-set values and is particularly significant when ammunition is being shot in which ballistics have not yet been programmed in, or if, for example, Air Burst Ammunition (ABM) is being shot, which is designed to detonate at a defined distance before or behind the target. Contained in the fire guidance device there are, moreover, several ballistic curves deposited for flight paths of different types of ammunition, or combat shells, and can be chosen via a menu incorporated in the fire guidance device.

Basically, there are two solutions for the set-up angle for all target distances, with the exception of the maximum flight distance of the missile, one in the lower angle group and one in the upper angle group. The solution for the lower angle group results, which pertains to increasing from 0° set-up angle (horizontal) with 0 meter target distance, in a required set-up angle of x° at y meter target distance. This value is always smaller than 45°. The solution for the upper angle group results, which pertains to decreasing from 90° set-up angle (vertical) with 0 meter target distance, in a required set-up angle of 90°-x° at y meter target distance. This value is always greater than 45°. Shooting in the upper angle group is meaningful with respect to special missiles, for example, for shooting with reconnaissance missiles (i.e., cameras with wireless data transmission in the shell) or for shooting with infra-red illumination missiles.

In case of special engagement scenarios, such as, for example, for combat behind covers, above houses or other obstacles, it makes sense to shoot in a steep upward direction. Smaller obstacles, however, can also be "overshot" in the lower angle group due to the heavily curved flight path of such missiles.

Programming of ABM ammunition, or other missiles, is also possible with the fire guidance device. With the aid of the infra-red laser target illuminator, which is aligned in the weapon axis, transfer of data to the missile can be effected by infra-red light after the missile has left the barrel of the weapon. The infra-red illuminator is mounted either at the holding device, or at the fixed weapon part of the fire guidance unit, parallel to the barrel axis of the weapon. The missile has appropriate built-in electronics and a source of electricity in the missile bottom of the infra-red receivers. It is possible, then, to transmit the data for ignition time, combat shell adjustment or other data to the missile using the fire guidance unit.

Direct alignment and aiming while the environment is dark are made possible with a red dot night-vision sighting device, a holographic sighting device etc., in or at the optical target device located on the fire guidance device, or by means of the installed laser target markers. This feature can be combined with the infra-red laser target illuminator for illumination in case of heavy darkness or in shady areas, as well as combined with (commercial) night vision glasses.

This fire guidance device of the invention is simple to operate. It has a trigger cable, whose scanners can be placed on the weapon in ergonomically beneficial manner. Attachment of cable and scanner is done, for example, by means of "Velcro" or other simple means. Additional scanners may also be at the trigger cable in order to perform other operating procedures, such as, for example, Laser on/off or measuring of distance without fire guidance.

The fire guidance device further has a preferred emergency mode possibility. If the fire guidance device, due to an error or an electricity stoppage, is no longer able to automatically rotate in the required set-up angle, it is still possible to adjust the angle position of the fire guidance device and, thus, to correct the set-up angle by manual turning at a button, or the like, for example, on the rear side of the fire guidance device. An adjustment scale is also provided for that purpose at the fire guidance device. The required angle values for adjusting, for the various ammunition types and distances, can be specified in a table on the device, or in a table in the display of the device, or in a table in the operating instructions for the device.

The fire guidance device is intended to be mounted on the weapon and thereby is designed for the special challenges resulting there from, such as the need for low weight, small size, and robust construction including steadfast, reliable firing. Parts of the target device located outside the fire guidance device, such as an optical target device, can simply be attached at the fire guidance device with a mechanical holding means at picatinny rails (i.e., a bracket used on various tactical weapons in order to provide a standardized mounting platform for scopes and other accessories such as tactical lights and laser sighting modules). This feature has the additional advantage that optical target devices can be integrated into the engagement scenario according to a customer's desire, or in an adjustable fashion. The holding device for the weapon, the trigger cable, the target assistance means can simply be exchanged or replaced. In combination with the easily selectable ballistic, the fire guidance device is thus universally employable for different types of weapons.

As already mentioned, with various ammunitions, (for example 40 mm) a disproportionate spin correction is desirable. The spin correction can, as already mentioned, be undertaken with adjustment of the fire guidance device by means of tilting of the weapon. By manually tilting of the fire guidance device during adjustment of set-up angle, a lateral correction is additionally provided, which corresponds to the amount of spin deviation and extends in the opposite direction. The lateral correction depends upon the tilting angle and the set-up angle. By variation of tilting angle, it is thus possible in accordance with the present invention to adjust the lateral correction. Inasmuch as the ratio of set-up angle to distance is disproportionate, the lateral correction is likewise disproportionate in proportion to the distance. In other words, both the set-up angle and the tilting angle will depend upon the distance the weapon is firing from the target.

The desired spin correction, as a correction of the lateral correction, is therefore effected by means of a constant correction angle percentage and an additional variable correction angle percentage, whereby the constant correction angle is proportionate to the distance, while the variable correction angle grows disproportionately with increasing distance. The constant correction percentage is specified by assignment during adjustment of the fire guidance device in that the fire guidance device, relative to the axis of the weapon, is intentionally adjusted in horizontal alignment by the required angle with the assistance of an adjustment table. In other words, during adjustment of the fire guidance device the axis of the fire guidance device, for correction of spin, is not adjusted parallel to the weapon axis and also is not adjusted to a point in a defined distance; instead, adjustment is made by a defined constant angle in horizontal alignment between the axes of the fire guidance device and the weapon. A variable portion, in turn, is created in that the fire guidance device is not mounted vertically at the weapon but is canted. This variable portion is made possible in a simple fashion due to a skewed assembly of the fire guidance device at the weapon. By dimensioning the adjusted lateral angle during adjustment and the tilting angle at the holding device, the steepness and the curvature of the correction curve can be adapted to a required spin correction curve.

Alternatively to the canted mounting of the fire guidance device, the fire guidance device can also be mounted vertically and the shooter is informed of the required tilt at the display unit of the fire guidance device, which he then must adjust. This information can be represented in the display in the form of an artificial horizon as a sloping line, or as a horizontally to be aligned symbol, etc. The representation is preferably dynamic, wherein the tilting angle is measured cyclically and the display is represented according to size and direction of tilt. The display of the properly adjusted tilt angle can then be done by means of an LED or by a vibration element disposed at the scanner of the trigger cable. A minor height error is created by twisting, which is equalized during the adjustment of the set-up angle via the fire guidance device.

By selection and combination of the correct value for the proportional and disproportional correction portion, the correction curve can be very well approximated to the spin deviation curve. For fine adjustment of inclination and curvature of the disproportional curve to the actually existing spin deviation, the proportional and disproportional corrections are combined. By correction of the linear and disproportional amounts of correction, it is possible for each combination of weapon and ammunition to be exactly re-formulated to the required size and curvature of the spin correction.

The invention thus concerns a fire guidance device for a weapon that is to shoot ammunition with an extended or super-elevated flight path, which is supported by rapid target change and can be deployed during day and night. The fire guidance device is particularly suited for use with hand firing weapons based on its small size and low weight. The installed distance meter and other sensors for ballistic-relevant parameters improve the initial hit probability and increase the number of achieved hits. With the optical or holographic target aid assemblies, and also with the installed laser target markers in the visible and in the infra-red range, the ability to fight at night is made possible when combined with night vision glasses. Special ammunition for infra-red battle field illumination, or reconnaissance missiles with built-in camera, are shot off in the upper angle group (45° to 90°), even though these angles cannot be adjusted with current sighting devices.

BRIEF DESCRIPTION OF THE DRAWINGS

The invention is explained in more detail using an exemplary embodiment with drawings, as follows.

DETAILED DESCRIPTION OF THE INVENTION

Figure 1:
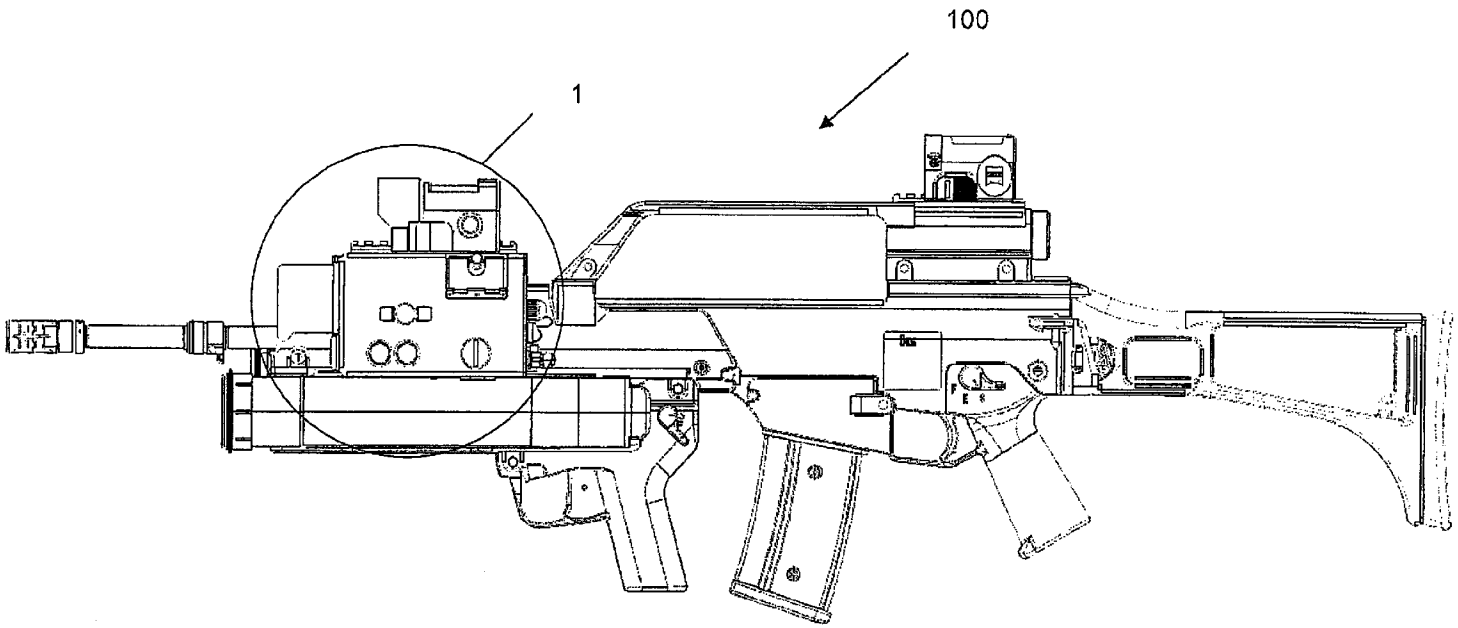
FIG. 1 depicts a weapon with fire guidance device in a starting position in accordance with the present invention.

FIG. 1 shows a weapon 100, in this case an assault rifle with 40 mm grenade thrower, at which is attached, laterally—in this case on the left hand side—a fire guidance device 1. The fire guidance device 1 is in a starting position. The representation thus corresponds to the basic position, i.e., no set-up angle has been entered. In this basic position, the fire guidance device 1 is mounted and adjusted while parallel on the tubular axis of the bore of the weapon 100 (i.e., the bore axis of the weapon).

Figure 2:
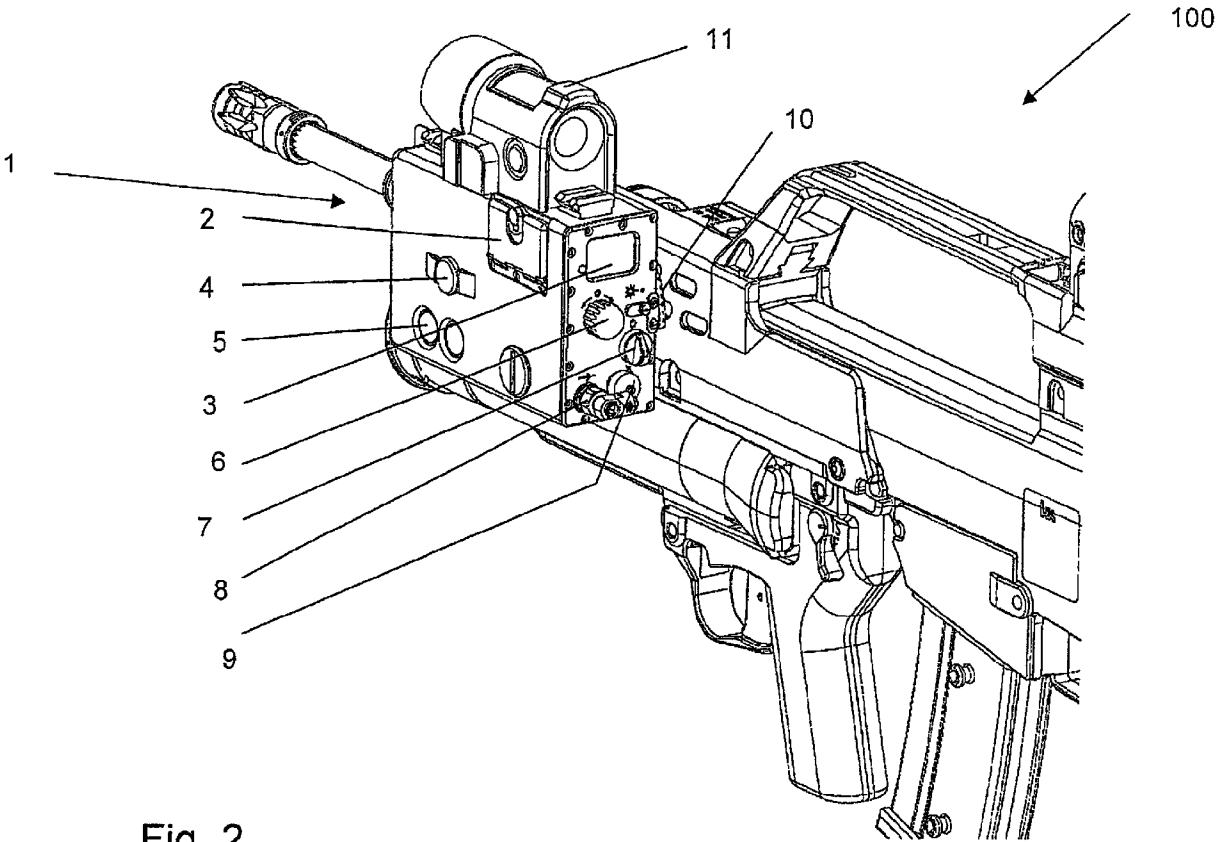
FIG. 2 depicts a perspective view of the fire guidance device of the invention at the weapon as seen from the rear.

FIG. 2 depicts a perspective view of the fire guidance device 1 on the weapon 100 as seen from behind. Character reference 2 identifies a battery compartment for containing batteries, and character reference 3 identifies a display for target indication. Additional operational components shown here in FIG. 2 include a lateral adjustment 4, operating buttons 5, and a turning button 6 for menu operation as well as an on/off switch 7. A connection 8 serves for joining the fire guidance device 1 with a trigger switch at the weapon (not represented in more detail) via a trigger cable. For emergency operation, another button 9 and a dial are provided. An optical target device 11 is preferably attached above on the fire guidance device.

Figure 3:
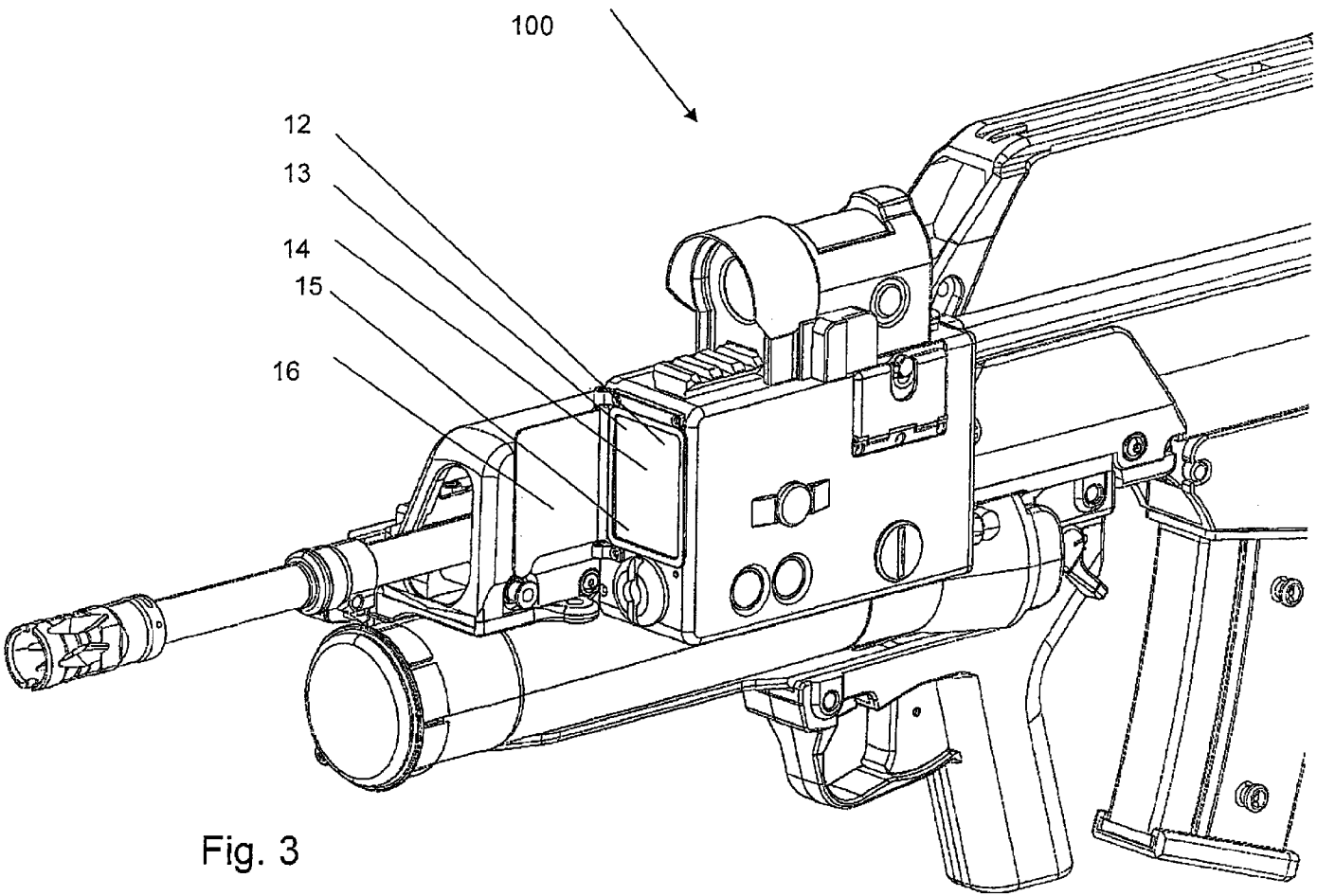
FIG. 3 depicts a perspective view of the fire guidance device of the invention at the weapon as seen from the front.

In addition, the fire guidance device preferably comprises a red light laser marker 12 and a red light laser marker 13, and infra-red target illuminator 14 and a laser distance meter 15 as shown in FIG. 3. The elements, in turn, can be integrated at the anterior side of the fire guidance device 1. A protective cover 16 is movable to protect the fire guidance device 1 when not in use against dirt etc. (See FIG. 3). Not shown in more detail, but is a preferred component of the fire guidance of fire guidance device 1, is a computer, in which are entered in the computer's memory various ballistic curves as well as spin correction curves and spin correction angles, etc., for determination of set-up angle. The computer operationally further serves for processing or manipulation of the measuring values obtained by the sensors of the fire guidance device, and signal emission used for adjustment of the set-up angle.

The operating mode of the fire guidance device 1 is as follows:

The complete fire guidance process preferably takes place in a fully automatic way.

After aiming at the target with the laser target marker 12, 13 and/or the optical target assistance means 11, etc., the trigger scanner is pressed against the weapon 100. This results in a read-out of the installed, but not more closely represented, sensors and of, perhaps, recorded parameters, (i.e., a distance meter for measuring the target distance, an inclination meter for measuring the target line inclination, an inclination meter for measuring swivel, an air pressure sensor for measuring air pressure, preferably also a temperature sensor for measuring the temperature of the environment, and an angle coder for measuring the adjusted set-up angle) and calculation takes place with respect to the set-up angle and, possibly, calculation of the flight time for ABM, wherein the calculations are performed by the computer of the fire guidance device. A laser illuminator mounted parallel vis-à-vis the axis of the weapon (not shown here) permits data transfer to the missile per infra-red light, after the projectile has left the barrel of the weapon. To this end, the missile has an appropriate receiver with electronics and a source of electricity so that the missile may receive information transmitted by the fire control device.

Figure 4:
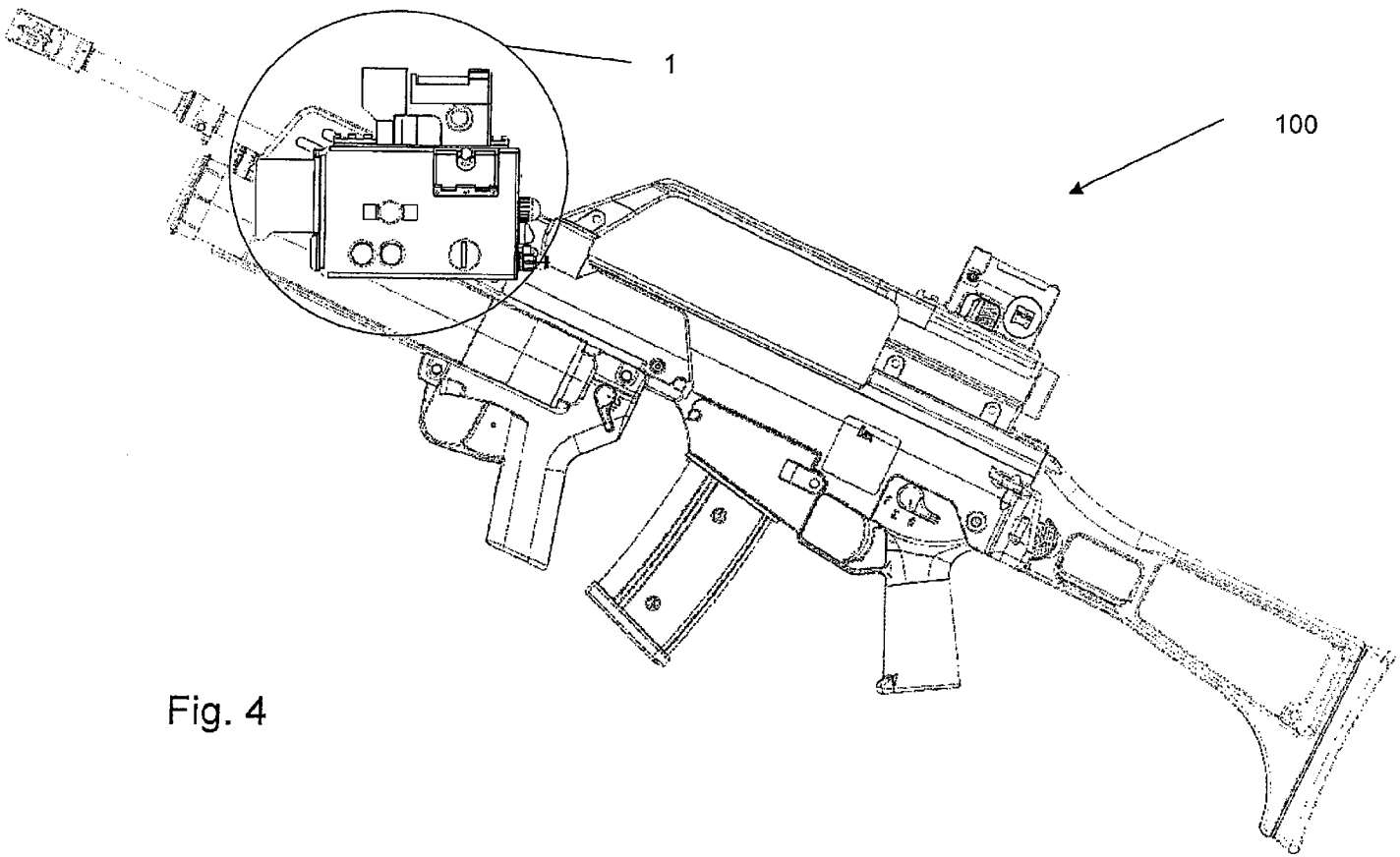
FIG. 4 depicts a weapon provided with fire guidance device with adjusted set-up angle in accordance with the present invention.

After the above steps are taken, the complete fire guidance device 1 is twisted automatically by its target assembly so as to be provided with the required angles for set-up and potential spin correction. The shooter again takes aim at the target, wherein he aims directly at the target with the aid of the fire guidance device 1 so that the weapon 100 is set up and the shooter is able to shoot on target. In other words, when the target assembly of the fire guidance device 1 automatically twists the fire guidance device relative to the tubular axis of the bore of the weapon 100, the fire guidance device may be twisted along a pivot axis and along a lateral axis relative to the weapon (See, e.g., FIGS. 6 and 7). Therefore, when the shooter resights the weapon 100 by direct line-of-sight using the fire guidance device 1 and/or the optical target device 11, the weapon 100 will be reoriented to the line-of-sight axis as shown in FIG. 4 instead of in the starting position or basic position shown in FIG. 1. When the weapon 100 is reoriented relative to the direct line-of-sight as shown in FIG. 4, the weapon is oriented so as to account for the set-up angle (angle of elevation required to hit a target according to distance) and the tilting angle (angle of lateral axis required to hit a target according to the spin correction required based on the distance to the target) as shown schematically in FIG. 7.

The line of sight and the direction of the fire guidance device 1 are hereby in agreement with respect to accurate targeting. The complete process is very quick and can be intuitively performed by the shooter so as to not overburden the shooter during a tense battle situation.

Figure 5:
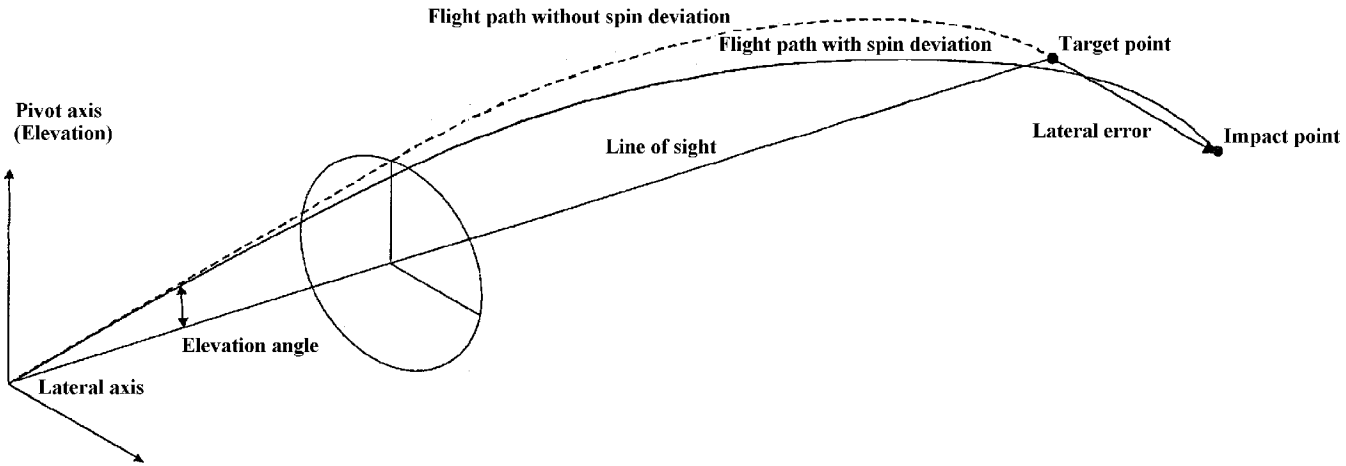
FIG. 5 depicts a representation of the lateral error with drift to the right.
Figure 6:
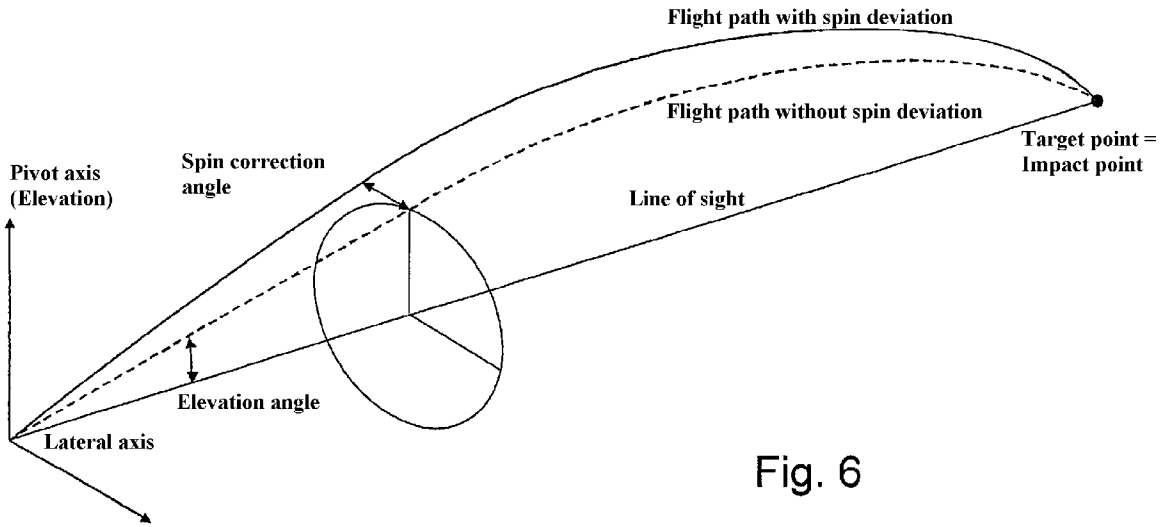
FIG. 6 depicts a representation of spin correction, in accordance with the present invention, by automatic or manual twisting of the tubular axis of the weapon in relationship to the line-of-sight viewing line of the fire guidance device or optical target device.

FIG. 4 depicts the fire guidance device 1 with adjusted set-up angle of the weapon 100. The fire guidance device 1 with laser marker 12, 13, or the optical target assistance means 11, etc., is aimed at the target (not shown) while weapon 100 points in an upward direction with the required set-up angle needed to accurately shoot the target. As shown in FIG. 4, while the fire guidance device is oriented along the direct line-of-sight to the target, the barrel of the weapon 100 is inclined relative to the direct line-of-sight in accordance with the required set-up angle FIG. 5 shows a representation of the already extensively described lateral error, which can be corrected by a spin correction angle as indicated in FIG. 6. In FIG. 5 and FIG. 6, a straight line between the weapon (i.e., located at the intersection of the lateral axis and pivot axis, or "origin") and the target represents the light of sight path from weapon to target. In FIGS. 5 and 6, a hypothetical flight path for the fired ammunition or missile without spin deviation is shown by the hatched line from the origin (i.e., where the weapon is located) to the target point. FIG. 5 shows the flight path of a fired ammunition or missile at a particular elevation angle relative to the light of sight that is intended to cause the fired ammunition or missile to strike the target point. However, FIG. 5 illustrates how, due to lateral error (i.e., see straight solid arrow from target point to impact point), the flight path of the ammunition, or missile, due to spin deviation results in an impact point for the ammunition or missile that deviates from the target point (i.e., location of the target). The flight path of the fired ammunition or missile with spin deviation from origin to the impact point is shown by a curved solid line in FIGS. 5 and 6. FIG. 6 shows how, using a fire guidance device 1 according to the present invention, the computer of the fire guidance device 1 determines the corrected elevation angle (i.e., the correct elevation angle plus the spin correction angle) that is needed so that the flight path with spin deviation accounted for will result in the ammunition or missile striking the target point (i.e., location of the target).

Figure 7:
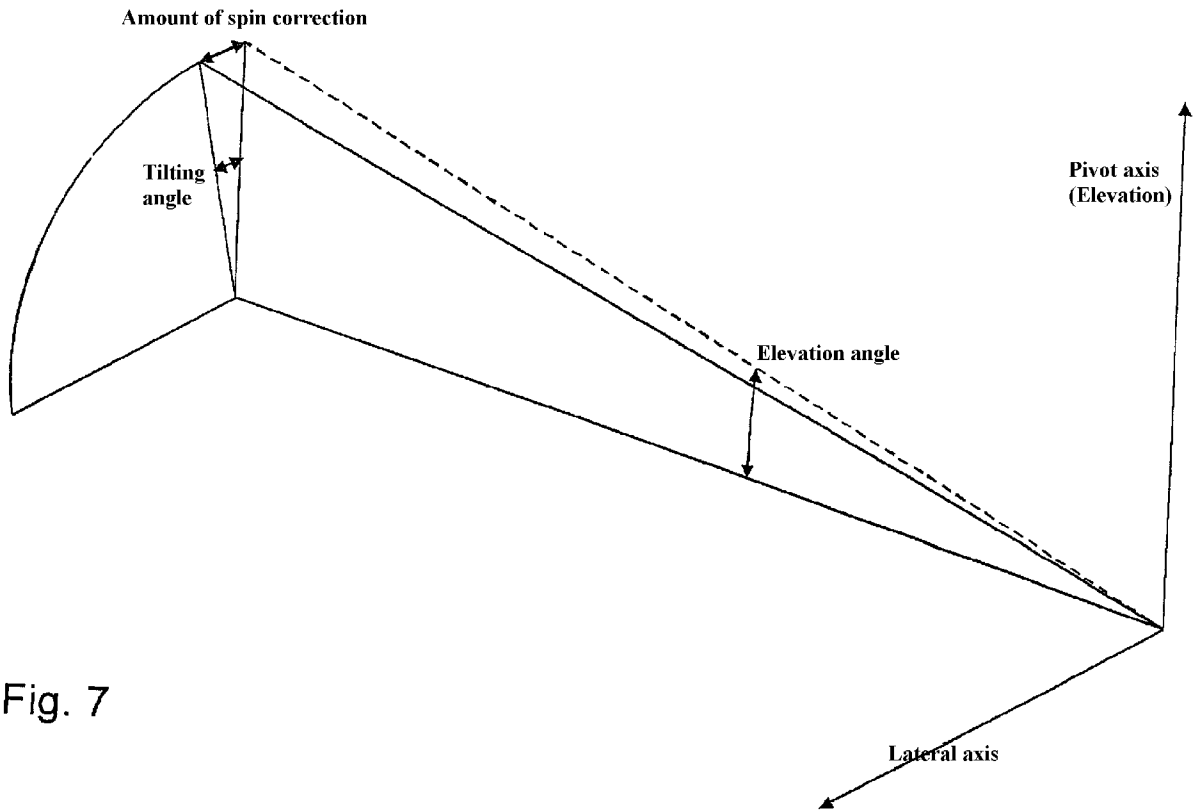
FIG. 7 depicts a representation of the spin correction by manual or automatic tilting of the weapon in accordance with the present invention.

FIG. 7 depicts a representation of spin correction by tilting of the weapon. In FIG. 7, the line of sight between the origin of the pivot axis-lateral axis to the target point is shown by a straight line, and the appropriate elevation angle to account for the distance to the target, and the appropriate tilting angle to account for spin correction with respect to the ammunition or missile to be fired, are shown. Thus, as shown in FIG. 7, the weapon must be tilted upwards along the pivot axis to the elevation angle required to correct for the line of sight distance between the weapon and the target, and the weapon must be tilted laterally along the lateral axis to the tilting angle required to correct for the amount of spin correction needed. Thus, the weapon is tilted by the required elevation angle along the pivot axis as evident from FIG. 4, and is also tilted by a tilting angle in the lateral direction as evident from FIG. 7.

In sum, the present invention pertains broadly to a fire guidance device (1) for a hand fired weapon (100) that is suitable for day and night deployment, in particular, for large caliber and slow flying ammunition or missiles for short and medium radius of action, such as, for example, 40 mm grenade throwers and anti tank weapons and similar weapons. The fire guidance device (1) also serves to determine and automatically adjust a set-up angle for adjustment of ballistics, and a lateral angle for spin correction for hand firing weapons with relatively large set-up angle. To that end, the fire guidance device (1) is attached to the weapon (100) so it can be tilted automatically or manually, and that twisting is thereby dependent upon a required set-up angle of the weapon (100) so that a direct view, by the operator of the hand fired weapon, to the target is preserved while the hand fired weapon is oriented to adjust for distance to the target and to correct for spin of the ammunition or missile. Tilting of up to 90° is provided for the fire guidance device. For spin correction, for example, a defined angle in horizontal orientation is adjusted between axes of the fire guidance device (1) and the weapon (100). Alternatively, the fire guidance device (1) is mounted vertically and a required cant (tilt) is then indicated in the display (3), which followed by tilt adjustment.

The invention claimed is:

1. A hand fired weapon for shooting ammunition or missiles with extended or super-elevated flight paths, wherein the hand fired weapon has a fire guidance device fastened to the weapon, wherein the fire guidance device is fastened on the weapon in a manner so that the fire guidance device swivels or twists automatically or manually relative to an axis of the weapon, wherein the fire guidance device swivels or twists from a basic position to a second position, wherein swiveling of the fire guidance device from the basic position to the second position is dependent upon a required set-up angle of the weapon so that when the fire guidance device is in the second position, a direct view towards a target via the fire guidance device, or via an optical target device connected to the fire guidance device, is preserved for an operator of the hand fired weapon while the weapon is oriented to accurately shoot ammunition or a missile at the target while correcting for distance between the weapon and the target.

2. A hand fired weapon according to claim 1, wherein the fire guidance device swivels up to 90° relative to a pivot axis.

3. A hand fired weapon according to claim 2, wherein integrated at the weapon are i. a distance meter operable to measure the distance of the target from the weapon;

ii. a first inclination meter operable to measure target line inclination;

ii. a second inclination meter for measuring tilting of the weapon relative to the basic position; and iii. an angle coder for determining an adjusted set-up angle.

4. A hand fired weapon according to claim 1, wherein an air pressure sensor and a temperature sensor are integrated in the fire guidance device of the weapon, wherein the temperature sensor operates to measure environmental temperature.

5. A hand fired weapon according to claim 1, wherein the fire guidance device comprises i. at least one red light laser marker;

ii. an infra-red laser marker;

iii. an infra-red laser target illuminator; and iv. a display.

6. A hand fired weapon according to claim 1, wherein the fire guidance device comprises a computer installed therein that operates to process or manipulate measured values obtained by individual sensors of the fire guidance device, and the computer operates to adjust the set-up angle of the fire guidance device at the weapon based on the measured values obtained by the individual sensors.

7. A hand fired weapon according to claim 6, wherein data are deposited in a memory of the computer, wherein the data comprises information selected from diverse ballistics curves, spin correction curves, and spin correction angles used by the computer to determine the required set-up angle.

8. A hand fired weapon according to claim 6, wherein a plurality of operating elements are affixed at the fire guidance device, wherein each operating element permits a manual input of a respective ballistic parameter to the computer of the fire guidance device so that the manual input of important ballistics parameters is possible in case of failure of one or more of the individual sensors.

9. A hand fired weapon according to claim 1 wherein a connection at the fire guidance device joins the fire guidance device with a trigger switch at the weapon via a connectable trigger cable.

10. A hand fired weapon according to claim 1, wherein the hand fired weapon includes a turning button and a scale, wherein the turning button and the scale are provided for emergency operation of the hand fired weapon.

11. A hand fired weapon according to claim 1, wherein an exchangeable optical target assistance device is mounted at the fire guidance device by a Picatinny rail.

12. A hand fired weapon for shooting ammunition or missiles with extended or super-elevated flight paths, wherein the hand fired weapon has a fire guidance device fastened to the weapon, wherein the fire guidance device is fastened on the weapon in a manner so that the fire guidance device swivels or twists automatically or manually relative to an axis of the weapon, wherein the fire guidance device swivels or twists from a basic position to a second position, wherein swiveling of the fire guidance device from the basic position to the second position is dependent upon a required set-up angle of the weapon so that when the fire guidance device is in the second position, a direct view towards a target via the fire guidance device, or via an optical target device connected to the fire guidance device, is preserved for an operator of the hand fired weapon while the weapon is oriented to accurately shoot ammunition or a missile at the target while correcting for distance between the weapon and the target, wherein the fire guidance device comprises:

i. a distance meter operable to measure the distance of the target from the weapon;

ii. a first inclination meter operable to measure target line inclination;

ii. a second inclination meter for measuring tilting of the weapon relative to the basic position; and iii. an angle coder for determining an adjusted set-up angle.

13. A hand fired weapon for shooting ammunition or missiles with extended or super-elevated flight paths, wherein the hand fired weapon has a fire guidance device fastened to the weapon, wherein the fire guidance device is fastened on the weapon in a manner so that the fire guidance device swivels or twists automatically or manually relative to an axis of the weapon, wherein the fire guidance device swivels or twists from a basic position to a second position, wherein swiveling of the fire guidance device from the basic position to the second position is dependent upon a required set-up angle of the weapon so that when the fire guidance device is in the second position, a direct view towards a target via the fire guidance device, or via an optical target device connected to the fire guidance device, is preserved for an operator of the hand fired weapon while the weapon is oriented to accurately shoot ammunition or a missile at the target while correcting for distance between the weapon and the target, wherein a spin correction angle comprises a defined angle in horizontal orientation adjusted between axes of the fire guidance device and the weapon, wherein the spin correction angle serves to correct for spin of the ammunition or the missile, wherein the fire guidance device is operable to tilt to the spin correction angle so that when the operator of the hand fired weapon takes the direct view towards the target via the fire guidance device, or via the optical target device connected to the fire guidance device, the weapon is oriented to accurately shoot ammunition or the missile at the target while correcting for distance between the weapon and the target and while correcting for spin of the ammunition or missile.

14. A hand fired weapon according to claim 13, wherein tilting of the fire guidance device occurs relative to a vertical axis of the weapon during adjustment of the set-up angle.

15. A hand fired weapon according to claim 13, wherein the fire guidance device is mounted vertically and indicates a required tilting at a display of the fire guidance device that is connected to receive output from a computer of the fire guidance device, wherein the required tilting of the fire guidance device is then performed either manually by the operator or automatically by the fire guidance device.

16. A hand fired weapon according to claim 15, wherein the tilting of the fire guidance device is represented in the display in the form of an artificial horizon comprising a sloping line or a symbol to be aligned vertically.

17. A hand fired weapon according to claim 16, wherein the representation of the tilt of the fire guidance device is dynamic, and the tilt angle is measured cyclically, and depending upon a magnitude and orientation of the tilt, the display accordingly represents the magnitude and orientation of a correctly adjusted tilt.

18. A hand fired weapon according to claim 17, wherein the display of the correctly adjusted tilt angle is effected by an LED or by a vibration element at a scanner of a trigger cable.

* * * * *